US005209539A

United States Patent [19]

Atalay

[11] Patent Number: 5,209,539

[45] Date of Patent: May 11, 1993

[54] PORTABLE GOLF CLUB CARRIER AND SUPPORT

[75] Inventor: Michael Atalay, Yorktown, Va.

[73] Assignee: Edge Technologies, Inc., Burlington, Vt.

[21] Appl. No.: 822,331

[22] Filed: Jan. 17, 1992

[51] Int. Cl.[5] ..... A63B 55/10

[52] U.S. Cl. ..... 294/143; 294/146; 211/70.2; 211/198

[58] Field of Search ..... 294/141-143, 294/146-148, 159-167, 169; 206/315.2; 211/60.1, 70.1, 70.2, 70.5, 70.6, 70.8, 198

[56] References Cited

U.S. PATENT DOCUMENTS

| | | | |
|---|---|---|---|
| 2,070,254 | 2/1937 | Burgner | 294/143 X |
| 2,465,096 | 3/1949 | Hunt | 294/146 X |
| 3,232,503 | 2/1966 | Thonen | 294/143 X |
| 3,370,696 | 2/1968 | Groe | 294/161 |
| 3,415,572 | 12/1968 | Zagwyn | 294/143 X |
| 4,074,739 | 2/1978 | Rodeghier | 294/146 X |
| 4,193,495 | 3/1980 | Keeley | 294/143 |
| 4,230,247 | 10/1980 | Lowe | 294/143 |
| 4,526,414 | 7/1985 | Jones | 294/143 |
| 4,666,038 | 5/1987 | Minneman | 294/146 X |
| 4,779,914 | 10/1988 | Friedline | 294/143 |

*Primary Examiner*—Johnny D. Cherry
*Attorney, Agent, or Firm*—Salzman & Levy

[57] ABSTRACT

A portable and collapsible golf club carrier and support device, capable of being stored in a conventional golf bag, for the retainment and transport of one or more golf clubs comprising a pair of downwardly extending, planar leg supports that are pivotally engaged with each other along the top portions thereof, preferably with a pin and hinge arrangement. The bottom portion of each leg support is contoured to accommodate the ground surface. The leg supports are movable between a collapsed position, wherein they are adjacent to each other, and a deployed position, wherein they are in a triangular relationship with a ground surface when resting thereon. The device also includes a handle that is pivotally and operatively engaged along the width of the leg supports, and adapted in size and shape to butt against the top portion of each leg support to allow the device to assume a predetermined triangular relationship with the ground surface. A pair of retention clips are joined to the outer surface of each leg support for detachably receiving and securing the shaft of individual golf clubs to the respective leg support. A golf ball and golf tee support may also be included for attachment to the outside surface of each or both leg supports.

19 Claims, 5 Drawing Sheets

PORTABLE GOLF CLUB CARRIER AND SUPPORT

BACKGROUND OF THE INVENTION

The present invention relates to a device for retaining and transporting golf clubs, and in particular to a portable, collapsible carrier and support for retaining and transporting golf clubs when it is impractical or inconvenient to use a conventional golf bag.

Typically, a golf bag will be used to carry a full complement of golf club drivers and irons, golf balls, tees, and other paraphernalia that will support or assist the golfer in playing the game. The conventional golf bag is usually adapted to be slung over the shoulder by a strap. As such, the golf bag will be heavy to carry under normal playing circumstances, thereby necessitating the use of a golf cart or caddie for transporting all of the equipment when playing a round of golf on a golf course. Even when the golf bag is left behind, transport of the clubs will often be clumsy and cumbersome. This is especially so when it is desired to use several select clubs at, for example, a practice tee or putting green, or more specifically at a driving range where golf bags are often not permitted or allowed on the premises because of strict rules that govern the conduct of a practitioner of the sport to prevent the theft of rented golf balls and golf clubs.

Accordingly, a person desiring to practice his game at a driving range will normally be required to select the clubs he wishes to practice with, and transport them to the driving range. At the same time, the golf bag will have to be left behind, usually in the trunk of the car. When transporting the selected clubs, the golf practitioner will have to carry them loosely to the driving range, along with any other equipment he chooses to bring with him, pay the requisite fee to rent the golf balls, and transport everything to the location from which he will practice his shots. Once reaching the location, the selected golf clubs will have to be laid down on the ground along side of the collection of golf balls, which are usually contained in a bucket, thereby leaving the clubs in disarray and subject to possible damage from abrasion with the ground or being stepped on.

What is desired then, is a device that will easily retain and support individual golf clubs and which can be used to transport them in a manner that is efficient and organized, while at the same time enabling such a device to be stored in a conventional golf bag when not in use. The latter feature will avoid the necessity of having duplicate carrier devices for storing golf clubs which would not only save on storage space but will also offer the player the option of using selected clubs without the need of a burdensome golf bag.

Numerous devices have been described for holding and carrying golf clubs which vary quite widely in versatility and function. For example, an array of golf club assemblies and devices has been described in patents as an alternative to the conventional golf bag and which are intended to replace the same. Thus, U.S. Pat. Nos. 2,064,433; 2,465,096; 2,987,109; 2,990,865; 3,215,181; 3,483,996; 4,036,416; 4,311,264; 4,666,038; and Des. 149,557 all describe devices for assembling or holding golf clubs that are intended to be used in lieu of or replace the usual golf bag. These devices, however lightweight and portable they may be, are either not compact enough for insertion and/or storage in a conventional golf bag or have other undesirable shortcomings.

Other golf club carriers, such as those set forth in U.S. Pat. Nos. 1,904,231; 2,737,990; 2,887,137; and 4,616,749, may be compact in nature, but have certain drawbacks that would not satisfy the purposes and objects of the device according to the invention herein. For example, the tubular device described in U.S. Pat. No. 2,737,990 contains a spike element that would tear a golf bag if inserted therein. And in U.S. Pat. No. 1,904,231 and 2,887,137, the devices disclosed therein do not lend sufficient upright stability when deployed, especially when the latter is placed on a hard ground surface. Furthermore, the carrier described in U.S. Pat. No. 4,616,749 is limited in the number of golf clubs that can be transported. It must also be inverted to carry the clubs contained therein.

It is therefore an object of the present invention to provide a useful device for the retainment and transport of golf clubs.

It is another object of the invention to provide a golf club carrier and support that will facilitate the retainment and transport of golf clubs in an orderly and efficient manner.

It is a further object of the invention to provide a carrier and support that will retain a plurality of golf clubs in a spaced apart horizontal relationship with respect to each other for easy transport and selectivity.

Yet another object of the invention is the provision of a golf club carrier and support that is collapsible to a sufficient compactness for easy insertion and storage in a conventional golf bag.

Another object of the invention is the provision of a golf club carrier and support that is lightweight and economical to manufacture.

And yet a further object of the invention is the provision of a golf club carrier and support that will additionally accommodate the support, storage and transport of golf balls and golf tees.

These and other objects of the invention will become more readily understood and apparent by reference to the following description of the various attributes and features of the invention in conjunction with the accompanying drawings.

SUMMARY OF THE INVENTION

In accordance with the present invention, there is provided a portable and collapsible golf club carrier and support device for the retainment and transport of one or more golf clubs to a desired location. The device is capable of being inserted and stored in a conventional golf bag and generally comprises a pair of downwardly extending, planar leg support members that are pivotally engaged with each other along the top portion thereof, preferably with a pin and hinge arrangement disposed along said top portion of each leg support. The leg support members are movable between a collapsed or folded position, wherein the leg support members are generally adjacent to and parallel with each other, and a deployed position, wherein the leg support members are in a triangular relationship with a ground surface when the device is rested thereon. The bottom portion of each leg support member is contoured to accommodate the ground surface when the golf club-containing device is in the deployed position. As such, the device is designed to rest upon the ground surface rather than being inserted into it.

The device also includes a handle that is pivotally and operatively engaged along the width of said leg supports, preferably with the same pin that pivotally engages the leg supports with each other. In order to prevent the leg supports from extending beyond their deployed position when the carrier device is rested on a ground surface, the handle is adapted in size and shape to butt against the top surface of each leg support member. This arrangement prevents the leg supports from collapsing to a flattened position with the ground surface and allows the device to assume a predetermined triangular relationship with the ground surface. Thus, the handle plays an integral role in the operation of the golf club carrier and support according to the invention herein.

Means for supporting the golf clubs are joined to the outer surface of each leg support for detachably receiving and securing the shaft of individual golf clubs to the respective leg support. The means preferably comprises at least one pair of retention clips. Each clip making up the pair of retention clips is transversely disposed apart from each other to support and retain the golf clubs in a generally horizontal and parallel relationship relative to each other.

Appurtenant to the golf club carrier and support are means for supporting golf balls and means for supporting golf tees which are located on either or both leg supports.

The means for supporting golf balls comprises a cylindrical housing that is joined to the outside of the leg support and adapted in diameter and length, with an appropriate flange disposed about the open ends thereof, to receive and retain a plurality of golf balls therein. The means for supporting golf tees comprises a rectangular plate whose longitudinal edge is horizontally disposed and preferably joined to the outer surface of the cylindrical housing of the means for supporting golf balls. Through openings are provided in the rectangular plate which are adapted to removably receive golf tees.

Other advantages and features of the present invention may be obtained by reference to the accompanying drawings, detailed description, and the following claims.

DETAILED DESCRIPTION OF THE INVENTION

Figure 1:
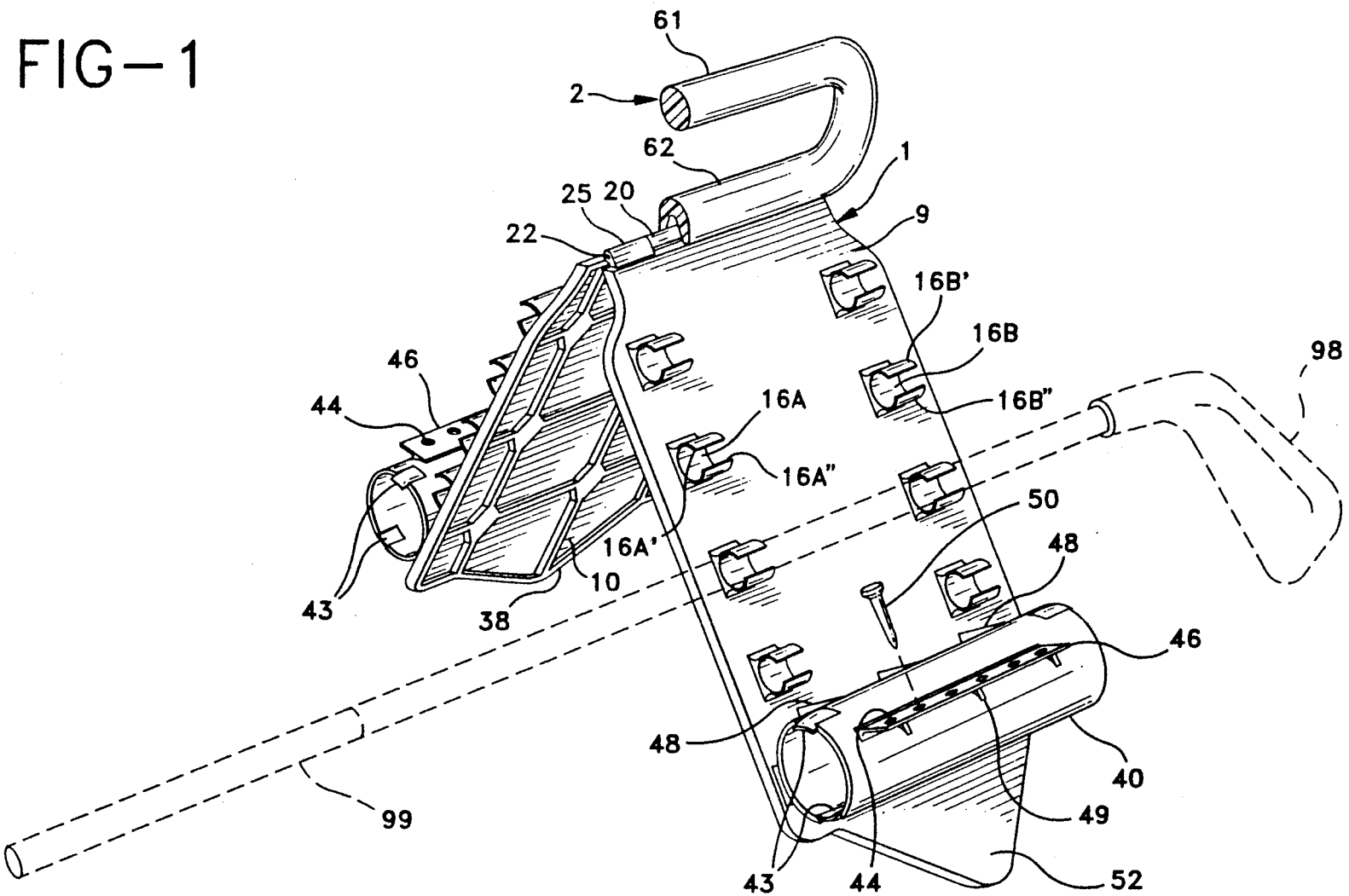
FIG. 1 is an isometric perspective view of the deployed golf club carrier and support with a golf ball and golf tee support means and with a partially removed section of the handle.
Figure 2:
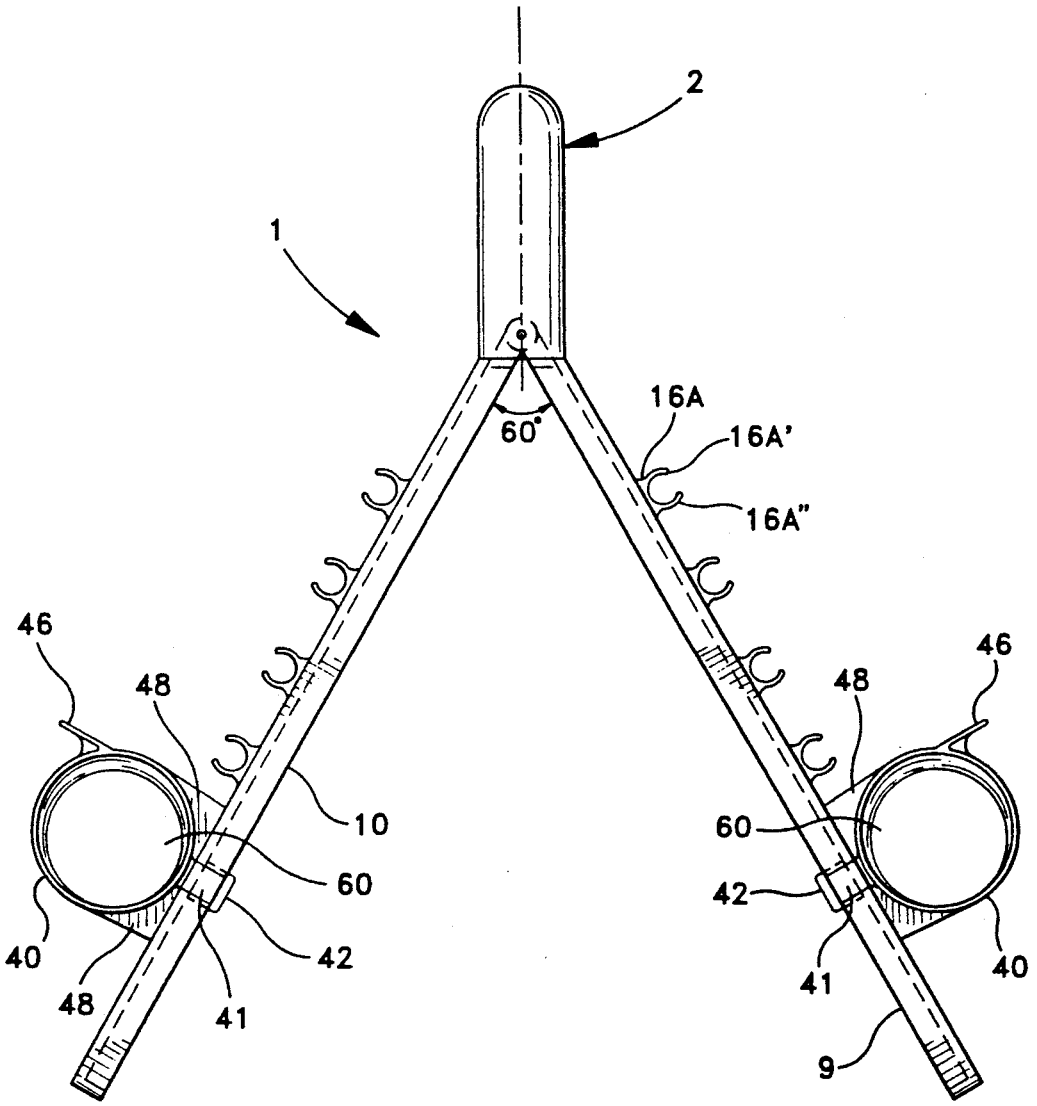
FIG. 2 is a side view of the golf club carrier and support shown in FIG. 1.
Figure 3:
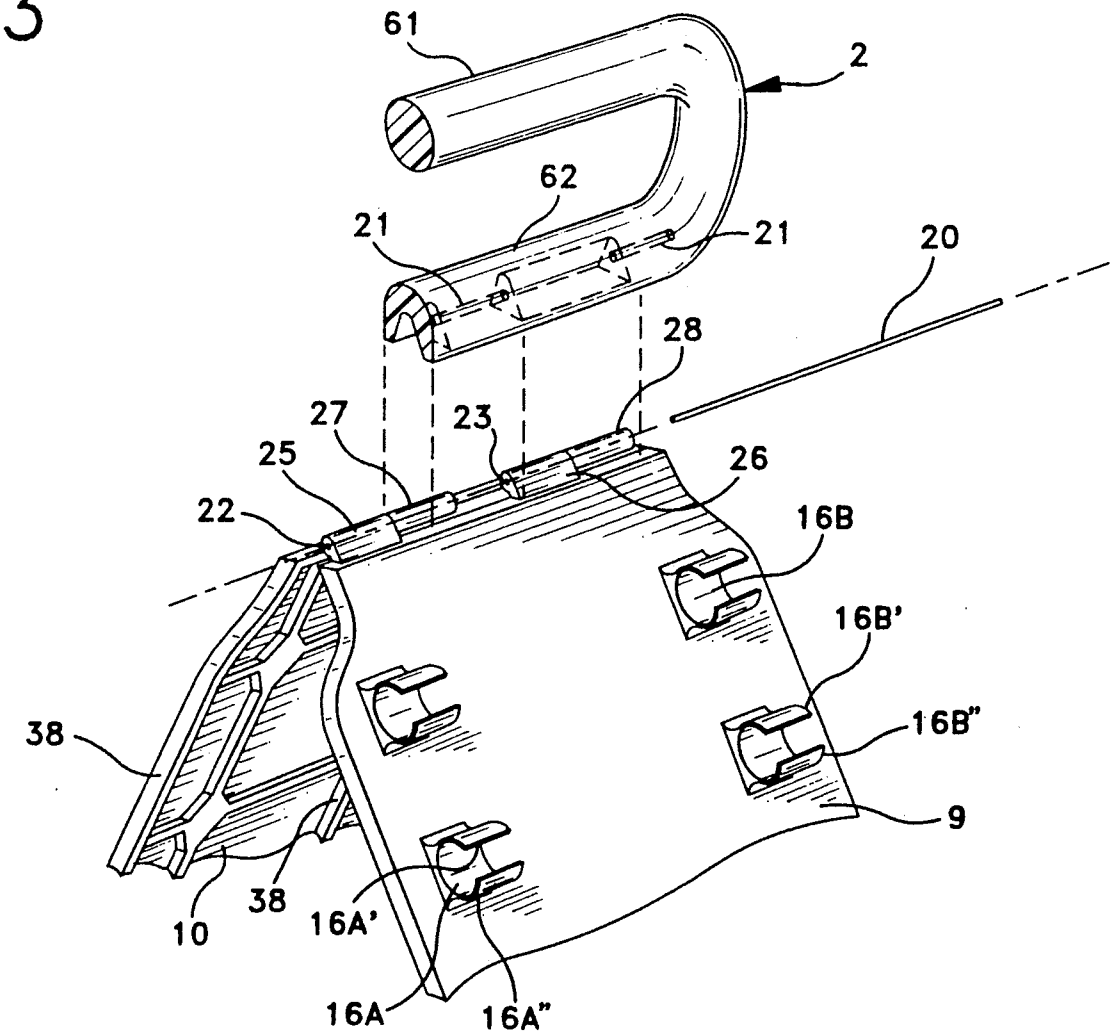
FIG. 3 is a isometric, partially exploded, perspective view of the golf club carrier and support shown in FIG. 1 detailing the engagement of the handle, leg supports, and pin.

A preferred embodiment of the golf club carrier and support device 1 for the retainment and transport of golf clubs, in accordance with the present invention, is illustrated in FIGS. 1 through 3. The carrier and support device 1 comprises a handle 2, a pair of symmetrical leg support members 9 and 10, a pin 20, and retention clips 16A and 16B joined to the outer surfaces of leg support members 9 and 10. The handle 2 is adapted to be pivotally engaged with leg supports 9 and 10 by the insertion of a pin 20 through a pair of hinge extensions 25 and 26, and 27 and 28, transversely disposed along the top surface of leg supports 9 and 10, respectively, and through an opening 21 along the length of the lower section 62 of said handle 2.

More specifically, leg support members 9 and 10 generally have a symmetrical planar configuration reinforced by a rib construction 38 disposed horizontally, vertically and about the perimeter of the reverse side of each leg support. Leg support 9 has a pair of hinges 25 and 26 with openings 22 and 23, respectively, transversely spaced apart from each other and extending beyond the top surface of leg support 9. In similar fashion, leg support 10 also has a pair of hinges 27 and 28 with respective openings transversely spaced apart and extending beyond the top surface of leg support 10. By referring to FIG. 3, it will be seen that hinges 25 and 26 on leg support 9, and hinges 27 and 28 on leg support 10, are offset with respect to each other. Thus, when they are brought together, they are aligned to permit insertion of pin 20 through each of hinge openings 22 and 23 of respective hinges 25 and 27 and like openings (not shown) of hinges 26 and 28, as well as opening 21 in the lower section 62 of handle 2. Pivotal movement of leg supports 9 and 10 about pin 20 is thereby facilitated.

As illustrated in FIGS. 1 through 6, the leg supports and respective hinges, reinforcing rib construction, and retention clips are integrally molded together as one article of construction, although for the purposes of the invention herein, they can be separate members that are joined together by any means known to a person skilled in the art.

As can best be seen in FIG. 3, handle 2 of device 1 has a generally solid rectangular construction whose shorter sides are rounded between the upper grip section 61 and a partially hollowed lower section 62. Lower section 62 of handle 2 has a generally solid construction containing two hollowed pockets that are adapted in shape and size to encompass hinges 25 and 27, and 26 and 28, therein when handle 2 is pivotally engaged with leg supports 9 and 10, as is shown in FIG. 3. The remaining solid portion of lower section 62 is adapted in shape and size to fit between hinge 27 of leg support 10 and hinge 26 of leg support 9, as well as to be adjacent to hinge 28 of leg support 10 and hinge 25 of leg support 9. Opening 21 forms an axis within the solid portion of lower section 62 to receive pin 20 when the handle 2 is placed over the top surface of leg supports 9 and 10, thereby enabling handle 2 and leg supports 9 and 10 to be operatively and pivotally engaged with each other about pin 20. The width and bottom of lower section 62 is adapted in shape and size to butt against the top surfaces of leg supports 9 and 10 in order to prevent the leg supports from extending beyond an angle of approximately 60° relative to each other when the golf club carrier and support device 1 is deployed on a ground surface. In order to prevent pin 20 from falling out of the respective openings through which it is inserted, as described above and as shown in FIGS. 1 and 3, the cross sectional opening 21 within lower section 62 is adapted in size to be slightly smaller than the diameter of pin 20 to permit a press fit and retainment of the pin within handle 2.

Means for supporting a golf club is joined to the outer surface of each leg support 9 and 10 for detachably receiving and securing the shaft of a golf club to the respective leg support, as will be seen in FIGS. 1 to 4. Referring specifically to FIGS. 1 and 3, the means comprises a pair of retention clips 16A and 16B horizontally disposed and generally parallel with the top portion of the leg support member. Retention clips 16A and 16B preferably comprise a pair of opposing arcuately shaped arms 16A',16A" and 16B',16B", respectively, that are spaced apart and terminate inwardly to permit reception and retainment of the shaft 99 of golf club 98 therebetween. The retention clips are preferably made of a resilient thermoplastic material that will engage and retain golf club shaft 99, and return to its original shape after the golf club 98 has been removed from the respective pair of retention clips. Each pair of retention clips 16A and 16B is vertically positioned apart from the other pairs on leg supports 9 and/or 10 to retain a plurality of golf clubs in a generally parallel relationship relative to each other.

Figure 4:
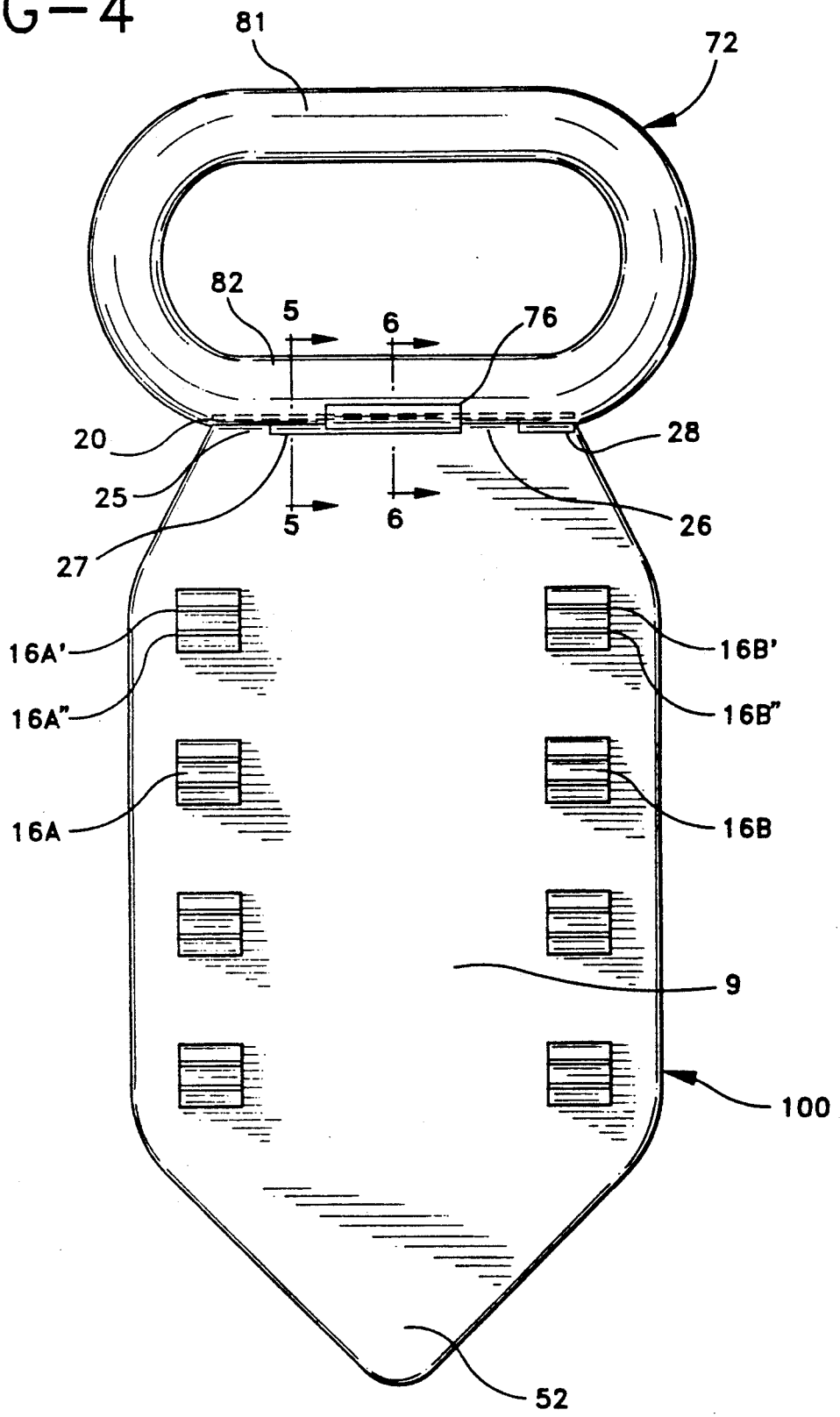
FIG. 4 is a front elevational view of an alternative embodiment of the golf club carrier and support without a golf ball and golf tee support means.

When a golf club is secured to carrier and support device 1 via retention clips 16A and 16B, and leg supports 9 and 10 are extended to their deployed position, which are desirably 60° apart from each other, the device will act as a tripod when rested upon a ground surface, with the shaft 99 of golf club 98 performing as the third leg of the tripod. As such, the device itself will be tilted toward the ground surface from the vertical position shown in FIG. 2, and in order to accommodate the ground surface when the golf club-containing device 1 is deployed and rested thereon, the bottom portion 52 of leg supports 9 and 10 are provided with the general shape and contour of a v, as is illustrated in FIGS. 1, 2 and 4. It will be appreciated that the golf club carrier and support according to the invention is not self supporting without a golf club or clubs being retained by the device, thereby providing the distinct advantage of being lightweight, compact, and capable of being stored in a conventional golf bag.

The golf club carrier and support may additionally include a golf ball support and a golf tee support as is shown in FIGS. 1 and 2. In the illustrations shown, the golf ball and golf tee supports are located on each of leg supports 9 and 10. The golf ball support embodied herein comprises a cylindrical housing 40, open at both ends, that is secured to the outside surface of leg supports 9 and 10 by means of a pair of capped pins 41 joined to and extending perpendicularly from housing 40 (see FIG. 2). Pins 41 are spaced apart from each other along the cylindrical axis of said housing and are provided with a flexible cap 42 formed from a resilient plastic material such that when they are inserted with pressure into equally spaced openings (not shown) contained in leg supports 9 and 10, the circumferential edge of the flexible caps 42 is squeezed inwardly and returned to its original shape after their insertion through the respective openings in said leg supports. Housing 40 can thereby be snapped into place and attached to the leg support of the golf club carrier and support 1. Additional securement of housing 40 to leg supports 9 and 10 is ensured by the provision of housing struts 48 therebetween, said struts being deployed along and attached to the outside surface of said housing 40.

Housing 40 is adapted in diameter and length to receive and retain up to three golf balls. Means for retaining a golf ball 60 is disposed at both ends of housing 40, said means preferably comprising a pair of opposing and inwardly turned flanges 43, segmented and made from the same resilient plastic material of housing 40. It will be appreciated that flanges 43 possess the degree of flexibility in a radially extending direction from the cross sectional center of housing 40 that will permit insertion and retention of golf ball 60 in said housing by the natural action of said flanges 43 springing back to their original inwardly turned position. Accordingly, it will be apparent that golf balls 60 can be inserted or removed from housing 40 by applying a force to the ball from the human hand which will in turn expand flanges 43 to allow the golf ball to pass in either direction relative to said flanges 43. If only one or two golf balls are retained in housing 40, their removal can be effected by exerting pressure on the golf ball through the use of the finger or grip end of a golf club from either direction of the housing's open ends.

The golf tee support is preferably joined to the golf ball support means as illustrated in FIGS. 1 and 2. The golf tee support means preferably comprises a rectangular plate 46, one longitudinal edge of which is horizontally disposed and fixed to the outer surface of cylindrical housing 40, said plate 46 being supported by tee struts 48 joined to the underside of plate 46 and the surface of housing 40. As shown in FIG. 1, through openings 44 are provided in plate 46 which are adapted in size and shape to removably receive golf tees 50 for storage and transport.

Figure 5:
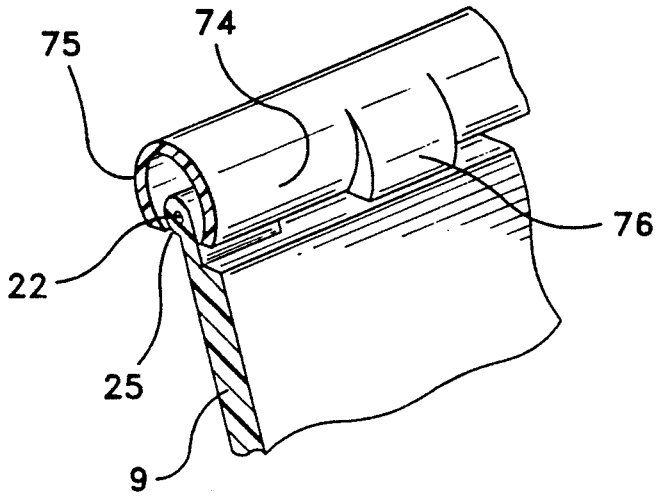
FIG. 5 is an isometric perspective view of the bottom section of the handle and leg support as taken along the line 5—5 in FIG. 4.
Figure 6:
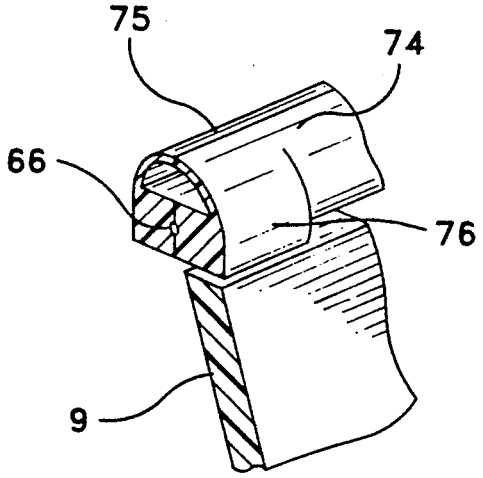
FIG. 6 is an isometric perspective view of the bottom section of the handle and leg support as taken along the line 6—6 in FIG. 4.

The invention also includes, but is not limited to, the golf club carrier and support device illustrated in FIGS. 4 to 6. Device 100 shown in FIG. 4 is similar to device 1 shown in FIGS. 1 to 3, and comprises a handle 72, leg supports 9 and 10 (leg support 10 not shown in FIG. 4), pin 20, and a pair of retention clips 16A and 16B, the differences lying with the absence of a golf ball and golf tee support and minor variations in the design of the handle 72.

Thus, handle 72 comprises a generally rectangular construction whose shorter sides are rounded between the upper grip portion 81 and a partially hollowed bottom section 82 that is parallel with the grip portion 81, the difference being that handle 72 has a circular and substantially hollow cross section (see FIG. 5) formed from two symmetrical and mateable half members 74 and 75 that are suitably joined or bonded together by means that are generally known to a person skilled in the art. A solid core section 76, disposed in the central lower section 82 of handle 72 and consequently in each half member 74 and 75, is formed by joining the two half members 74 and 75, said core 76 being adapted in length to fit between hinge 26 of leg support 9 and hinge 27 of leg support 10, as shown in FIG. 4. Core section 76 is also adapted in width and shape to butt against the top surfaces of leg supports 9 and 10 when handle 72 is engaged with said leg supports and the leg supports are extended to their deployed position, preferably not more than approximately 60° relative to each other. Disposed within the length of core 76 is an opening 66 adapted in diameter to receive pin 20 which pivotally engages handle 72 with leg supports 9 and 10 when said pin is inserted through the openings of their respective hinges 25 and 26, and 27 and 28.

Assembly and engagement of handle 72 to leg supports 9 and 10 is achieved by first inserting pin 20 through the respective hinge openings of said leg supports followed by joining the handle members 74 and 75 to each other such that opening 66 within core 76 envelops pin 20 between hinges 27 and 26 (see FIGS. 5 & 6). The hollow nature of handle 72 thus lends itself to containing and protecting the hinge assembly of leg supports 9 and 10 as well as offering a reduction in the amount of plastic material employed for the handle's manufacture.

In the illustrations shown, the golf club carrier and support devices 1 and 100, including respective leg supports 9 and 10, retention clips 16A and 16B, handles 2 and 72, golf ball support means, and golf tee support means, are formed from a rigid and resilient plastic material, for example from a mold injected thermoplastic resin, preferably from any number of the polycarbonate resins available from the General Electric Corporation under the trademark Lexan TM. Pin 20 is preferably formed from stainless steel. It will be understood, however, that different or other types of resins or plastic materials can be used in forming the golf club carrier and support device that are compatible with the stated purposes and functions of each member making up the device according to the invention described herein. By using such plastics, or combination of plastic materials, the longevity of the devices will be extended and the economical cost for their manufacture greatly improved.

Since other modifications and changes may be varied to fit particular purposes and environments, as will be apparent to those skilled in the art, the invention is not considered to be limited to the specific embodiments chosen for the purposes of disclosure, and covers all changes and modifications which do not constitute departures from the true spirit and scope of this invention.

What is claimed is:

1. A portable, collapsible device for supporting and retaining a plurality of golf clubs and capable of being stored in a conventional golf bag, comprising:

a) a pair of downwardly extending, planar leg support members, each having a top and bottom portion, pivotally engaged with each other along the top portions thereof, the bottom portion of each leg support member having contoured means for resting upon a ground surface when said device is deployed thereon;

b) a handle pivotally and operatively engaged with the top portions of said leg support members; and c) a pair of retention clips joined to the outer surface of each leg support member for detachably receiving and securing the shaft of a golf club to said device;

whereby i) said leg support members are movable between a collapsed position wherein they are adjacent to each other, and a predetermined deployed position wherein they are in a triangular relationship with said ground surface;

ii) said handle comprises means for maintaining said leg support members at said predetermined deployed position; and iii) said leg support members and the shaft of said golf club form a tripod.

2. The device according to claim 1 wherein the bottom portions of said leg support members have a V-shaped contour.

3. The device according to claim 1 wherein reinforcing ribbing is disposed about the reverse side of said outer surface of each leg support member.

4. The device according to claim 3 wherein said leg support members, handle, retention clips and reinforcing ribbing are formed from a mold injected thermoplastic resin.

5. The device according to claim 4 wherein said retention clips and associated leg support members form an integral unit.

6. The device according to claim 1 wherein said leg support members are pivotally engaged with each other by means of a vertically extending hinge disposed along the top portion of each leg support member, each of said hinges having an opening therein and adapted to receive a pin therethrough about which the leg support members pivot between said collapsed and said deployed positions.

7. The device according to claim 6 wherein said leg support members are pivotally engaged with each other by means of a pair of vertically extending hinges disposed and spaced apart along the top portion of each leg support member.

8. The device according to claim 6 wherein each associated vertically extending hinge, leg support member and retention clips form an integral unit.

9. The device according to claim 6 wherein said handle comprises transverse upper and lower parallel members connected by side members, said lower member being pivotally and operatively engaged with and along the axis of said pin by means of an opening that is transversely disposed through a solid core portion within said lower member for receiving said pin, said solid core portion having a bottom surface for butting against the top portion of each leg support member for maintaining said leg support members at their predetermined deployed position.

10. The device according to claim 9 wherein the upper, lower and side members of said handle have a substantially solid construction.

11. The device according to claim 9 wherein said upper, lower and side members comprise two mateable and symmetrical halves suitably joined together to form a substantially hollow handle.

12. The device according to claim 6 wherein each associated retention clips, leg support member and vertically extending hinge form an integral unit.

13. The device according to claim 1 which additionally comprises means for removably retaining a golf ball.

14. The device according to claim 13 wherein said means for retaining a golf ball comprises an open ended cylindrical housing comprising a pair of opposing and inwardly turned flexible flanges at each open end of said housing that will permit insertion and retention of said golf ball within said housing.

15. The device according to claim 14 wherein said flexible flanges are segmented and formed from the same material of said housing.

16. The device according to claim 14 which additionally comprises means for removably retaining a golf tee.

17. The device according to claim 16 wherein said means for removably retaining a golf tee comprises a rectangular plate have an opening therethrough that is adapted in size and shape to receive a golf tee for storage and transport, a longitudinal edge of said plate being horizontally disposed and fixed to the outer surface of said cylindrical housing for retaining a golf ball.

18. A portable, collapsible device for supporting and retaining a plurality of golf clubs and capable of being stored in a conventional golf bag, comprising:

a) a pair of downwardly extending, planar leg support members, each having a top and bottom portion, pivotally engaged with each other to form an axis along the top portions thereof, the bottom portion of each leg support member having contoured means for resting upon a ground surface when said device is deployed thereon;

b) a handle pivotally and operatively engaged with said leg support members along the axis of the top portions of said leg support members;

c) a pair of retention clips joined to the outer surface of each leg support member for detachably receiving and securing the shaft of a golf club to said device;

d) means for removably retaining a golf ball; and e) means for removably retaining a golf tee;

whereby i) said leg support members are movable between a collapsed position wherein they are adjacent to each other, and a predetermined deployed position wherein they are in a triangular relationship with said ground surface;

ii) said handle comprises means for maintaining said leg support members at said predetermined deployed position when said device is rested on said ground surface; and iii) said leg support members and the shaft of said golf club form a tripod.

19. A portable, collapsible device for supporting and retaining a plurality of golf clubs and capable of being stored in a conventional golf bag, comprising:

a) a pair of downwardly extending, planar leg support members, each having a top and bottom portion, pivotally engaged with each other by means of a vertically extending hinge disposed along the top portions thereof, said hinge having an opening therein and adapted to receive a pin therethrough about which said leg support members pivot to and from a collapsed position, wherein they are adjacent to each other, and a predetermined deployed position, wherein they are in a triangular relationship with a ground surface when rested thereon, the bottom portion of each leg support member comprising contoured means for resting upon said ground surface when said device is deployed thereon;

b) a handle comprising transverse upper and lower parallel members connected by side members, said lower member being pivotally and operatively engaged with and along the axis of said pin by means of an opening that is transversely disposed through a solid core portion within said lower member for receiving said pin, said solid core portion having a bottom surface for butting against said top portion of each leg support member to maintain said leg support members at their predetermined deployed position;

c) a pair of retention clips joined to the outer surface of each leg support member for detachably receiving and securing the shaft of a golf club to said device;

d) means for removably retaining a plurality of golf balls comprising an open ended cylindrical housing comprising a pair of opposing and inwardly turned flexible flanges at each open end of said housing for permitting insertion and retention of said golf balls within said housing; and e) means for removably retaining a plurality of golf tees comprising a rectangular plate having a plurality of openings therethrough that is adapted in size and shape to receive said golf tees, a longitudinal edge of said plate being horizontally disposed and fixed to the outer surface of said cylindrical housing of said means for retaining a plurality of golf balls;

whereby said leg support members and the shaft of said golf club form a tripod.

* * * * *